United States Patent [19]

Ullmer

[11] 4,184,544

[45] Jan. 22, 1980

[54] APPARATUS AND METHOD FOR RECOVERING WASTE HEAT FROM FLUE GASES

[76] Inventor: Harold J. Ullmer, 4981 Shirley St., Las Vegas, Nev. 89119

[21] Appl. No.: 846,795

[22] Filed: Oct. 31, 1977

[51] Int. Cl.[2] ..... F28F 1/36; B23P 15/26

[52] U.S. Cl. ..... 165/184; 29/157.3 AH

[58] Field of Search ..... 165/184, 182, 181, 179, 165/183, DIG. 2, DIG. 12; 29/157.3 A, 157.3 AH

[56] References Cited

U.S. PATENT DOCUMENTS

| | | | |
|---|---|---|---|
| 242,300 | 5/1881 | Gold | 165/184 |
| 1,960,305 | 5/1934 | Emmons et al. | 165/184 |
| 2,656,158 | 10/1953 | Hodson et al. | 29/157.3 A |
| 2,756,032 | 7/1956 | Dowell | 165/156 |
| 3,083,662 | 4/1963 | Zeidler | 29/157.3 A |

FOREIGN PATENT DOCUMENTS

| | | | |
|---|---|---|---|
| 1104979 | 4/1961 | Fed. Rep. of Germany | 165/182 |
| 561785 | 6/1944 | United Kingdom | 165/184 |
| 659114 | 10/1951 | United Kingdom | 165/184 |
| 800265 | 8/1958 | United Kingdom | 165/184 |

OTHER PUBLICATIONS

Edmund Scientific Catalog, "Flue Pipe Heat Exchanger", (No. 72,149) p. 37.

*Primary Examiner*—Charles J. Myhre
*Assistant Examiner*—M. Moy
*Attorney, Agent, or Firm*—Gerlach & O'Brien

[57] ABSTRACT

A heat exchange attachment is wound around a flue pipe for heat transfer from the pipe to the surrounding atmosphere. The attachment includes a pliable elongated band of conductive material having a longitudinally elongated inverted channel-like projecting portion, a longitudinally elongated strip-like contacting portion adjoining the projecting portion therealong on either side thereof, and a longitudinal series of spaced apart transverse cuts dividing the projecting portion into a longitudinal series of individual projecting members. The contacting portions are disposed substantially in surface contact with the outer surface of the pipe, and the members project outwardly into the atmosphere surrounding the pipe with the adjacent edges of successive members spaced apart for air flow between and within the members. The attachment may be mounted on a flue pipe by screw fastening means.

11 Claims, 8 Drawing Figures

APPARATUS AND METHOD FOR RECOVERING WASTE HEAT FROM FLUE GASES

This invention relates to apparatus and a method for recovering waste heat contained in hot gases discharged through a flue pipe. More particularly, the invention relates to a heat exchange attachment and its use on a flue pipe to transfer heat from the pipe to the surrounding atmosphere.

Substantial amounts of heat are lost when hot gases from a combustion chamber are discharged through a flue pipe to the outside atmosphere. It would be advantageous to recover the heat now being wasted and utilize the waste heat.

An important object of the invention is to provide a heat exchange attachment for a flue pipe, and a heat recovery method utilizing the attachment, which increase the transfer of heat from a flue pipe to the surrounding atmosphere, where it may be utilized for heating purposes, thereby conserving energy and lowering the temperature of the combustion gases discharged from the pipe, which in turn lowers stack temperatures and reduces thermal pollution of the atmosphere.

A particular object is to provide an attachment and recovery method which may be employed readily and economically by homeowners and other relatively non-technical individuals to recover and utilize for heating purposes in an efficient manner a large additional increment of heat from the flue pipes serving to discharge hot gases from the combustion chambers of stoves, heaters, fireplaces, furnaces, boilers and other heating units. The recovered energy advantageously may be utilized for heating the enclosures in which the flue pipes extend.

Another object is to provide a heat exchange attachment for a flue pipe, which serves to transfer heat to the surrounding atmosphere by conduction, radiation and convection, the attachment being especially adapted to induce convection currents adjacent to its surfaces. An accompanying object is to provide an attachment that makes good and sufficient contact with the flue pipe for heat transfer by conduction therefrom.

An additional object is to provide a compact, lightweight and durable heat exchange attachment which when installed, presents no sharp edges that might constitute a hazard.

A further object is to provide an attachment which accomplishes the foregoing objects and which may be supplied in one size for use with flue pipes of different sizes and which adjusts itself to the pipe diameter. An accompanying object is to provide an attachment that may be supplied in any convenient length which maintaining to a minimum the number of units required.

A still further object is to provide such an attachment that need only be wound around a flue pipe to provide effective and reliable heat transfer, with no need for any adjustments, and that will remain securely in place once installed.

The invention provides a heat exchange attachment employed in combination with a flue pipe for discharging hot gases, which attachment comprises a pliable elongated band of conductive material having a longitudinally elongated inverted channel-like projecting portion, a longitudinally elongated strip-like contacting portion adjoining the projecting portion therealong on either side thereof, and means providing a longitudinal series of spaced apart transverse cuts in the projecting portion dividing the latter into a longitudinal series of individual projecting members, the attachment being wound around the pipe with the contacting portions disposed substantially in surface contact with the outer surface of the pipe for conduction of heat from the pipe to the contacting portions, and the members projecting outwardly from the contacting portions into the atmosphere surrounding the pipe with the adjacent edges of successive members spaced apart thereby to enable air to flow between and within the members for heat transfer to the surrounding atmosphere.

The invention also provides a method of recovering waste heat contained in hot gases discharged through a flue pipe, which method comprises the steps of providing the above-described heat exchange attachment, winding the attachment around the pipe so as to dispose the contacting portions substantially in surface contact with the outer surface of the pipe for conduction of heat from the pipe to the contacting portions, and so as to cause the members to project outwardly from the contacting portions into the atmosphere surrounding the pipe with the adjacent edges of successive members spaced apart thereby to enable air to flow between and within the members for heat transfer to the surrounding atmosphere, and fixing the attachment on the pipe.

The invention and the foregoing and other objects, advantages and functions thereof will be apparent on reference to the description which follows and to the attached drawings illustrating a preferred embodiment of the invention, in which like parts are identified by like reference symbols in each of the views, and in which.

Figure 1:
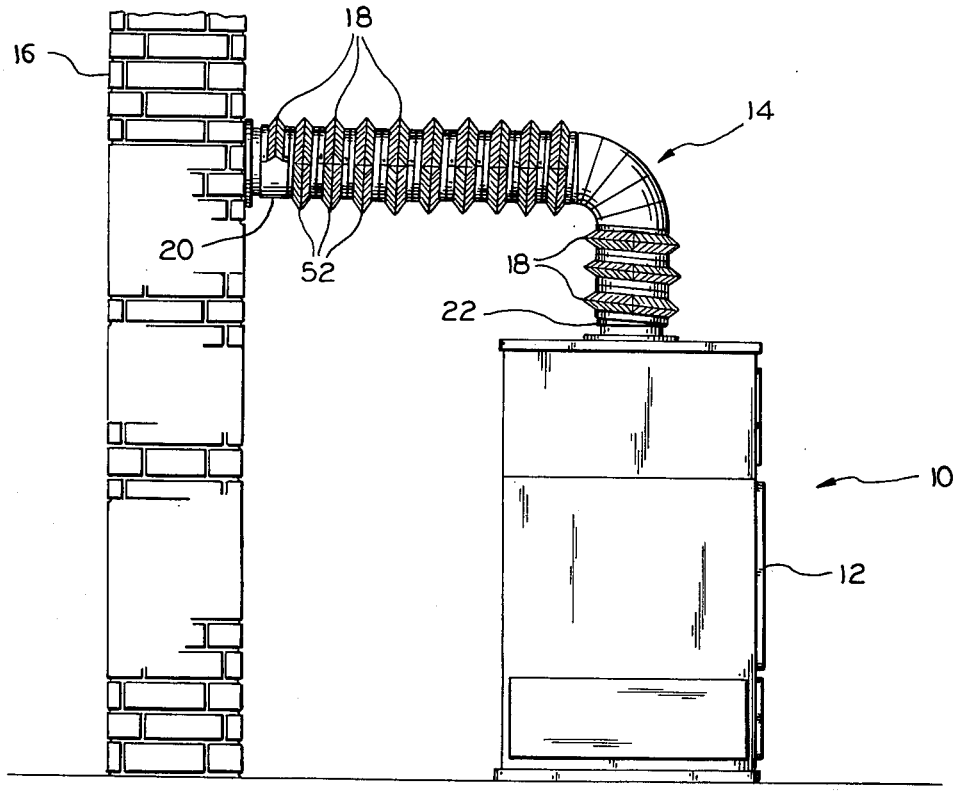
FIG. 1 is a side elevational view of an illustrative heating system in which a heat exchange attachment according to the invention is employed.

Referring to the drawings, particularly FIG. 1, the invention is illustrated as employed with a heating system 10 which includes a furnace 12 having an internal combustion chamber (not illustrated), a flue pipe 14 connected to the furnace 12 in communication with its combustion chamber, and a chimney 16 into which the combustion gases are discharged from the flue pipe 14 and which discharges the gases from its open top into the outside atmosphere. The furnace 12 and the flue pipe 14 may be mounted in any appropriate enclosure, such as in a living, storage or processing area of a dwelling or other building. A plurality of heat exchange attachments 18 is mounted on the horizontal and vertical spans 20 and 22, respectively, of the flue pipe 14. The attachments 18 function to increase the heat transfer from the flue pipe 14 to the surrounding atmosphere and thereby supply an additional quantity of heat to the room in which the system 10 is situated.

Figure 2:
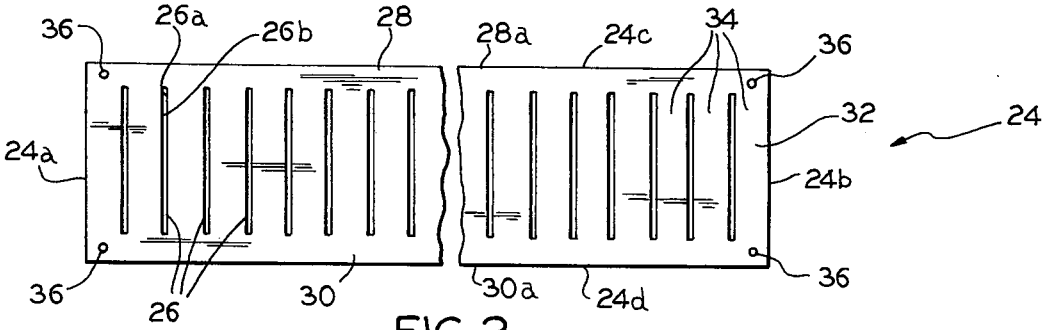
FIG. 2 is a broken plan view of a blank for the heat exchange attachment.
Figure 3:
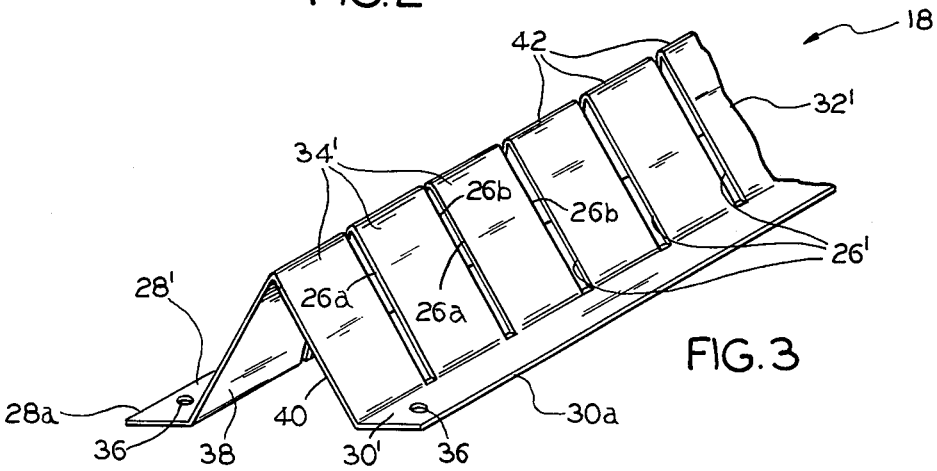
FIG. 3 is an enlarged fragmentary perspective view of an end portion of the attachment.

Referring to FIGS. 2 and 3, the heat exchange attachment 18 is formed from a blank 24. The blank 24 in the preferred embodiment is in the form of a relatively narrow elongated flat band. A preferred width for the blank is about 4 inches. The blank may be constructed in any suitable length, but shorter lengths are preferred, e.g., about 3-foot lengths. Dimensions for the blank of such order of magnitude render the attachment 18 easy to handle and install, readily adaptable to various pipe lengths, and convenient for storage, filling orders, packaging and shipping.

A longitudinal series of spaced apart transversely elongated narrow rectangular openings or cuts 26 is provided in the blank 24, such as by stamping. The openings 26 are congruent, and they are substantially equidistantly spaced apart between the opposite ends 24*a* and 24*b* of the blank. The opposite ends of the openings 26 are aligned transversely, and they are spaced equal distances from the opposite sides 24*c* and 24*d* of the blank 24. The openings 26 thus leave substantially continuous longitudinally elongated flat strip-like marginal portions 28 and 30 along the sides 24*c* and 24*d*, which portions adjoin a longitudinally elongated central portion 32 therealong.

Each opening 26 is bounded by two spaced apart parallel transverse edges 26*a* and 26*b*. In the illustrative embodiment, the width of the openings, between the edges 26*a* and 26*b*, is about ⅛ inch. However, wider or narrower cuts may be provided, down to narrow slits, if desired, while yet providing advantages according to the invention. The width in the illustrative embodiment is preferred for enhancing convection, as described hereinafter, while presenting a large heat transfer area. The length of the openings 26 and the corresponding width of the central portion 32 preferably is about 3 inches, thereby leaving marginal portions 28 and 30 each about ½ inch in width.

The openings 26 divide the central portion 32 into a corresponding series of individual or discrete transverse rectangular strip members 34. The strip members 34 have the same lengths, equal to the lengths of the openings 26, and the same widths, being about ½ inch in the illustrative preferred embodiment. The marginal portions 28 and 30 each have a fastener hole 36 adjacent to and spaced a small distance from each of the corresponding corners of the blank 24, which holes are adapted for inserting fasteners therethrough.

In the preferred method of production, the blank 24 is fabricated first, and a forming operation is performed on the blank to fabricate the attachment 18. In the forming operation, the central portion 32 is bent longitudinally and substantially centrally between its sides, preferably at an acute angle, and the blank is also bent longitudinally at obtuse angles at the junctions of the marginal portions 28 and 30, and the central portion 32. A longitudinally elongated inverted channel-like or hollow projecting portion 32' which is substantially V-shaped in transverse section is formed in the attachment 18 in this manner. The marginal portions 28 and 30 of the blank 24 remain in the same condition in the attachment 18, where they provide longitudinally elongated strip-like contacting portions 28' and 30' adjoining the projecting portion 32' therealong on either side thereof.

A longitudinal series of transverse openings or cuts 26' in the attachment 18 results from the provision of the openings 26 in the blank 24. The attachment openings 26' divide the projecting portion 32' into a longitudinal series of individual or discrete substantially V-shaped projecting members 34', which are formed from the transverse strip members 34 in the blank 24. The opposite ends of the projecting members 34' are integral with the contacting portions 28' and 30', respectively. Each of the projecting members 34' includes two flat sides or panels 38 and 40, which extend obliquely outwardly from the respective contacting portions 28' and 30', on one side of the attachment 18. The sides 38 and 40 of the members 34' are integrally united along outermost longitudinal ridges 42 on the members 34', whereby the individual members 34' extend continuously from one to the other of the contacting portions 28' and 30'. The ridges 42 are rounded or blunted, so that they present no hazard in the event of accidental contact of the body therewith.

In the illustrative embodiment, the sides 38 and 40 of the members 34' are substantially equal in length, extending about 1½ inch from the respective contacting portions 28' and 30'. The distance across the space between the ends of the sides 38 and 40, at the contacting portions 28' and 30', preferably is about 1 inch.

The fastener holes 36 in the contacting portions 28' and 30' serve to receive metal screws, friction fasteners, links or other fastening means. Registering holes may be provided in the spans 20 and 22 of the flue pipe 14, so that fasteners connected to the attachment 18 may be inserted through the pipe holes in engagement with the pipe, to affix the attachment to the pipe.

Figure 4:
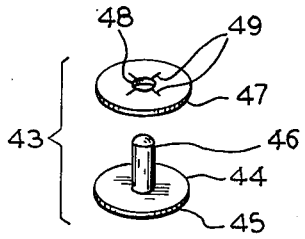
FIG. 4 is a further enlarged exploded perspective view of a fastener which is employed to connect together successive attachments.
Figure 5:
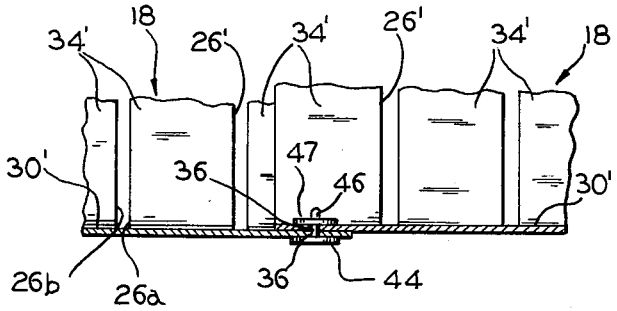
FIG. 5 is an enlarged fragmentary broken and sectional view of the adjoining ends of two successive attachments, illustrating the manner in which they are connected together by the fastener of FIG. 4.
Figure 6:
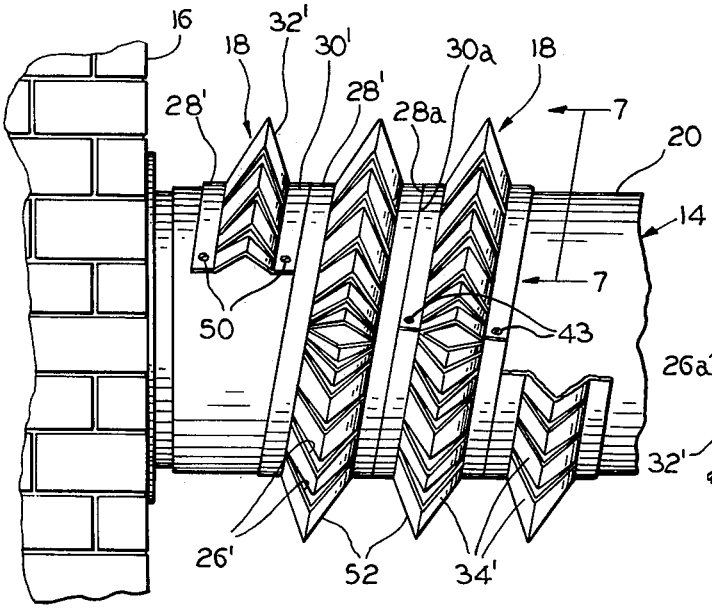
FIG. 6 is a fragmentary side elevational view of the structure illustrated in FIG. 1, enlarged with respect thereto.

When a plurality of successive attachments 18 is employed on a flue pipe, as in the illustrative embodiment, the adjacent ends of the attachments may be joined together by fastening means inserted through adjacent holes 36 on respective attachments. In a preferred construction, the attachments are secured together in overlapping relation, by means of button-type friction fasteners 43 as illustrated in FIGS. 4–6. The illustrative fastener 43 includes a button member 44 having a relatively thin, circular head 45 and a round shank 46 projecting axially from the head. The fastener also includes a friction clip or washer 47 having a central hole 48 and slits 49 extending from the hole. Two fasteners 43 are employed to connect two attachments 18 together at their overlapping ends, one fastener being employed on each side of the projecting portions 32'. The shank 46 of each fastener is inserted through two registering holes 36 in the attachments 18 where they overlap. With the shank 46 in alignment with the hole 48, the clip 47 is forced onto the shank, to secure the fastener 43 in place and thereby connect the attachments together, as illustrated in FIG. 5.

The blank 24 is fabricated from a pliable, conductive material, to provide the attachment 18 in the form of a pliable conductive band which may be bent to conform closely to the outer surface of the flue pipe 14, more particularly, to the outer surface of each of the substantially cylindrical horizontal and vertical spans 20 and 22. At the same time, the attachment 18 is sufficiently rigid to maintain its shape and perform its intended functions under ordinary use conditions. A preferred material of construction for the blank 24 is an aluminum alloy of about 0.016 inch thickness. The attachment 18 may be supplied with the bright metal finish of the aluminum alloy, or with another finish, as desired.

Thus, for example, the attachment 18 may be anodized or provided with a heat-resistant silicone or other coating. The attachment may be supplied in the form of straight lengths, as illustrated in FIG. 3, or it may be coiled, as desired.

Figure 7:
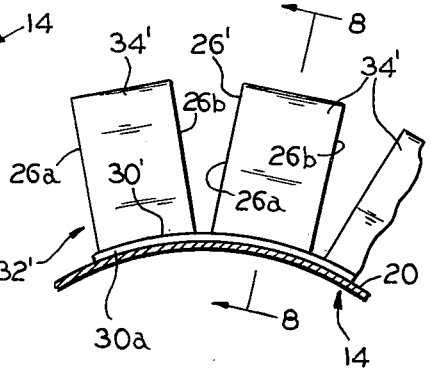
FIG. 7 is an enlarged fragmentary sectional view of the structure illustrated in FIG. 6, taken substantially on line 7—7 thereof.
Figure 8:
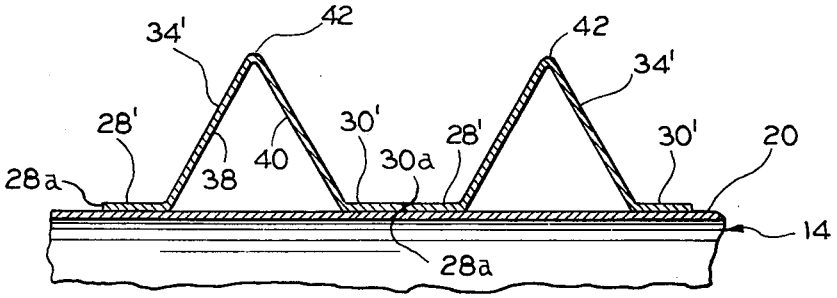
FIG. 8 is an enlarged fragmentary sectional view of the structure illustrated in FIG. 6, taken substantially on line 8—8 of FIG. 7.

Proceeding in accordance with the method of the invention, and referring particularly to FIGS. 1 and 6–8, a first attachment 18 is mounted on the horizontal span 20 of the flue pipe 14, commencing adjacent to the chimney 16. In the illustrative manner of mounting, a pair of holes is drilled in the flue pipe, for registry with the holes 36 in one end of the attachment 18, and the attachment is affixed to the pipe by inserting metal screws 50 through the registering holes in threaded engagement with the pipe. The remainder of the attachment 18 then is spirally wound around the pipe, in the clockwise direction. Alternatively, the attachment 18 may be wound in the counterclockwise direction. The pliability of the attachment 18 is such as to enable the contacting portions 28' and 30' to be mounted substantially in surface contact with the outer surface of the pipe 14, so that the contacting portions 28' and 30' are in heat conductive relation to the pipe, as illustrated in FIGS. 7 and 8.

A plurality of coils 52 is formed by winding, as illustrated in FIGS. 1 and 6. Each coil is composed of a longitudinal segment of each of the contacting portions 28' and 30', and of the projecting portion 32'. The winding preferably is effected so that the coils each have the longitudinal edges **28*a* and 30*a* of its segments of the contacting portions 28' and 30' disposed substantially in abutting relation to such edges of the coils adjacent thereto, as illustrated in FIGS. 6 and 8**.

When the length of the flue pipe or a span thereof is such as to accept more than one attachment 18, as in the illustrative embodiment, a plurality of successive attachments is employed, with their ends connected together as described above, and the succeeding attachments are wound around the pipe in like manner to the first one. While the ends of the contacting portions 28' and 30' are slightly raised off of the surface of the pipe where the attachments are connected together, the effect on the overall heat conduction from the pipe to the contacting portions is insubstantial. The free end of the last attachment 18 to be mounted on the pipe is secured to the pipe by screws 50 inserted through the holes 36 at that end, as illustrated and described above for the end of the first attachment 18 adjacent to the chimney 16. The mounting of one or more attachments on the vertical span 22 is accomplished in like manner. A part of the attachment 18 may be severed to complete an installation, in which case, fastener holes like the holes 36 may be formed at the severed end, for mounting purposes. Mounting of the attachments is completed rapidly, and the only tools required are a small drill and a screwdriver. No special skill is required.

The members 34' project outwardly from the contacting portions 28' and 30' into the atmosphere surrounding the flue pipe 14, with the adjacent edges **26*a* and 26*b* of successive members spaced apart thereby to enable air to flow between and within the members 34' for heat transfer to the surrounding atmosphere. The amount of space which results between successive members 34' depends on the width of the openings 26' provided in the blank 24, and also upon the diameter of the flue pipe 14. The attachment 18 having the illustrative dimensions is constructed in contemplation of use with the sizes of flue pipes more commonly used in households, mobile homes, and the like, which pipes generally are 4–6 inches in diameter. The attachment 18 having the illustrative dimensions also will improve the heat transfer from larger, less prevalent flue pipes, such as the 8 to 10-inch diameter sizes. Alternatively, the attachment 18 may be constructed in dimensions better suited for the larger sizes, including increased width of the openings 26'** or similar openings.

When hot gases are being discharged from the combustion chamber of the furnace 12 through the flue pipe 14, heat is transferred from the gases to the pipe. The heat then is transferred by conduction from the pipe spans 20 and 22 to the contacting portions 28' and 30' of the attachments 18, and thence to the projecting members 34'. Heat is transferred by conduction and radiation from the projecting members 34' to the surrounding atmosphere, thereby generating convection currents adjacent to the surfaces of the members 34'. Air flow paths exist over the contacting portions 28' and 30' and between the spaced apart segments of the projecting portion or portions 32' of adjacent coils 52. With the edges **26*a* and 26*b* of respective members 34' spaced apart to provide substantial openings 26' between the members in the projecting portion 32', air is induced to flow both externally and internally of the projecting portion 32', adjacent to the external and internal sides 38 and 40 of the members 34', to maximize heat transfer. If desired, forced circulation of air about the flue pipe 14 may be employed, to increase the heat transfer and the extent of circulation of the heated air. In this manner, waste heat is recovered and utilized economically, and as additional benefits, stack temperatures and thermal pollution of the atmosphere are reduced. The assembly of the flue pipe 14 and the attachment 18** is rugged and durable, resisting impacts while presenting no potentially injurious sharp projecting edges.

While preferred embodiments of the apparatus and method of the invention have been illustrated and described, it will be apparent to those skilled in the art that various changes and modifications may be made therein within the spirit and scope of the invention. It is intended that all such changes and modifications be included within the scope of the appended claims.

I claim:

1. In combination with a flue pipe for discharging hot gases, a heat exchange attachment which comprises a pliable elongated band of conductive material having a longitudinally elongated inverted channel-like projecting portion, a longitudinally elongated strip-like contacting portion adjoining the projecting portion therealong on either side thereof, and means providing a longitudinal series of spaced apart transverse cuts in said projecting portion dividing the latter into a longitudinal series of individual projecting members which extend continuously from one to the other of said contacting portions, said attachment being wound around said pipe with said contacting portions disposed substantially in surface contact with the outer surface of said pipe for conduction of heat from the pipe to the contacting portions, and said members projecting outwardly from said contacting portions into the atmosphere surrounding said pipe with the adjacent edges of successive members spaced apart thereby to enable air to flow between and within the members for heat transfer to the surrounding atmosphere.

2. A combination as defined in claim 1 and wherein said attachment is helically wound on said pipe to provide a plurality of coils each having the longitudinal edges of its segments of said contacting portions disposed substantially in abutting relation to such edges of the coils adjacent thereto.

3. A combination as defined in claim 1 and wherein said cuts form a corresponding series of openings in said projecting portion each bounded by spaced apart transverse edges.

4. A combination as defined in claim 1 and including means for fixing said attachment on said pipe which comprise holes in said contacting portions adjacent to their opposite ends and adapted for inserting fasteners therethrough.

5. A combination as defined in claim 1 and wherein said projecting portion is substantially V-shaped in transverse section.

6. In combination with a flue pipe for discharging hot gases, a heat exchange attachment which comprises a pliable elongated band of conductive material having a longitudinally elongated inverted channel-like projecting portion which is substantially V-shaped in transverse section, a longitudinally elongated strip-like contacting portion adjoining the projecting portion therealong on either side thereof, and means providing a longitudinal series of spaced apart transverse cuts in said projecting portion dividing the latter into a longitudinal series of individual projecting members which extend continuously from one to the other of said contacting portions, said attachment being helically wound around said pipe to provide a plurality of coils each having the longitudinal edges of its segments of said contacting portions disposed substantially in abutting relation to such edges of the coils adjacent thereto, said contacting portions being disposed substantially in surface contact with the outer surface of said pipe for conduction of heat from the pipe to the contacting portions, and said members projecting outwardly from said contacting portions into the atmosphere surrounding said pipe with the adjacent edges on successive members spaced apart thereby to enable air to flow between and within the members for heat transfer to the surrounding atmosphere.

7. A combination as defined in claim 6 and wherein said cuts form a corresponding series of openings in said projecting portion each bounded by spaced apart transverse edges.

8. A combination as defined in claim 7 and including means for fixing said attachment on said pipe which comprise holes in said contacting portions adjacent to their opposite ends and adapted for inserting fasteners therethrough, and screws inserted through at least the holes adjacent to one end of said attachment and into registering holes in said pipe, in threaded engagement with the pipe.

9. A method of recovering waste heat contained in hot gases discharged through a flue pipe, said method comprising the steps of:

providing a heat exchange attachment which comprises a pliable elongated band of conductive material having a longitudinally elongated inverted channel-like projecting portion, a longitudinally elongated strip-like contacting portion adjoining the projecting portion therealong on either side thereof, and means providing a longitudinal series of spaced apart transverse cuts in said projecting portion dividing the latter into a longitudinal series of individual projecting members which extend continuously from one to the other of said contacting portions, winding said attachment around said pipe so as to dispose said contacting portions substantially in surface contact with the outer surface of the pipe for conduction of heat from the pipe to the contacting portions, and so as to cause said members to project outwardly from said contacting portions into the atmosphere surrounding the pipe with the adjacent edges of successive members spaced apart thereby to enable air to flow between and within the members for heat transfer to the surrounding atmosphere, and fixing said attachment on said pipe.

10. A method as defined in claim 9 and wherein said winding is a helical winding which forms a plurality of coils each having the longitudinal edges of its segments of said contacting portions disposed substantially in abutting relation to such edges of the coils adjacent thereto.

11. A heat exchange attachment for a flue pipe and comprising a pliable elongated band of conductive material having a longitudinally elongated inverted channel-like projecting portion which is substantially V-shaped in transverse section, a longitudinally elongated strip-like contacting portion adjoining the projecting portion therealong on either side thereof, means providing a longitudinal series of spaced apart transverse openings in said projecting portion dividing the latter into a longitudinal series of individual projecting members which extend continuously from one to the other of said contacting portions, each of said openings being bounded by spaced apart transverse edges, and holes in said contacting portions adjacent to their opposite ends and adapted for inserting fasteners therethrough, said attachment thereby being adapted to be helically wound around a flue pipe so as to provide a plurality of coils each having the longitudinal edges of its segments of said contacting portions disposed substantially in abutting relation to such edges of the coils adjacent thereto, so as to dispose said contacting portions substantially in surface contact with the outer surface of the pipe for conduction of heat from the pipe to the contacting portions, and so as to cause said members to project outwardly from said contacting portions into the atmosphere surrounding the pipe with the adjacent edges of successive members spaced apart thereby to enable air to flow between and within the members for heat transfer to the surrounding atmosphere, and said attachment also being adapted to be affixed to said pipe by means of fasteners inserted through said holes and into engagement with the pipe.

* * * * *